US007267554B2

(12) United States Patent
Huang

(10) Patent No.: US 7,267,554 B2
(45) Date of Patent: Sep. 11, 2007

(54) CPU SOCKET WITH A CUSHION

(76) Inventor: Huang-Chou Huang, No. 377, Fu-Teh First Rd., Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/297,850

(22) Filed: Dec. 8, 2005

(65) Prior Publication Data

US 2007/0134950 A1 Jun. 14, 2007

(51) Int. Cl.
*H01R 12/00* (2006.01)

(52) U.S. Cl. ..... 439/73; 439/141; 439/66; 439/700; 439/246

(58) Field of Classification Search ..... 439/73, 439/188, 71, 266, 331, 259, 525, 141, 66, 439/700, 246–248
See application file for complete search history.

(56) References Cited

U.S. PATENT DOCUMENTS 5,791,914 A * 8/1998 Loranger et al. ..... 439/71
6,743,033 B2 * 6/2004 Tateishi et al. ..... 439/266
2004/0175979 A1 * 9/2004 Kazama ..... 439/188
2005/0159026 A1 * 7/2005 Ma et al. ..... 439/66
2006/0089016 A1 * 4/2006 Xie et al. ..... 439/71
2006/0178031 A1 * 8/2006 Lai ..... 439/331

* cited by examiner

*Primary Examiner*—Truc T. Nguyen
*Assistant Examiner*—Edwin A. Leon
(74) *Attorney, Agent, or Firm*—Jackson Walker, LLP

(57) ABSTRACT

A center processing unit (CPU) socket holds a CPU and has a base and a cushion. The base has a bottom, a contact seat, multiple contacts, a cover and a latch. The contact seat is mounted in the bottom and has a recess. The contacts are mounted in the recess in multiple lines. The cover is mounted pivotally on the base and has a latch tab. The latch has a locking tab selectively engaging the latch tab. The cushion is mounted in the recess and has multiple springs and a CPU backplate. The springs are mounted in the recess. The CPU backplate is mounted on the springs and has multiple slots corresponding to the contacts. The CPU backplate cooperates with the springs during installation of a CPU to oppose a force pushing the CPU down in the CPU socket so the contacts will not be damaged.

4 Claims, 5 Drawing Sheets

CPU SOCKET WITH A CUSHION

BACKGROUND OF THE INVENTION

1. Field of the Invention

The present invention relates to a central processing unit (CPU) socket, and more particularly to a socket that has a cushion to keep forces generated during CPU installation in the CPU socket from damaging the socket contacts.

2. Description of Related Art

Center processing unit (CPU) sockets are mounted on motherboards and hold CPUs for execution of programs.

Several types of CPU sockets are available with different structures. For example, an A standard CPU socket for a K7 CPU designed by AMD Corp.® has a bottom and multiple mounting holes defined through the bottom to hold pins on the K7 CPU.

Intel Corp.® designed a new Pentium 4 (P4) CPU and an LGA775 socket to hold the P4 CPU. The P4 CPU has a bottom and multiple contacts mounted on the bottom. The LGA775 socket has a cavity to hold the P4 CPU and multiple contacts in the cavity corresponding to and making contact with the contacts on the P4 CPU. However, the contacts are damaged easily or deformed permanently when the CPU is mounted in the socket with excessive force.

To overcome the shortcomings, the present invention provides a CPU socket with a cushion to mitigate or obviate the aforementioned problems.

SUMMARY OF THE INVENTION

The main objective of the invention is to provide a center processing unit (CPU) socket that has a cushion to keep forces generated during CPU installation in the CPU socket from damaging the socket contacts.

A center processing unit (CPU) socket in accordance with the present invention holds a CPU and has a base and a cushion.

The base has a bottom, a contact seat, multiple contacts, a cover and a latch. The contact seat is mounted in the bottom and has a recess. The contacts are mounted in the recess in multiple lines. The cover is mounted pivotally on the base and has a latch tab. The latch is mounted pivotally on the base and has a locking tab selectively engaging the latch tab.

The cushion is mounted in the recess in the base and has multiple springs and a CPU backplate. The springs are mounted in the recess in the base. The CPU backplate is mounted on the springs and has multiple slots corresponding to the contacts.

Other objectives, advantages and novel features of the invention will become more apparent from the following detailed description when taken in conjunction with the accompanying drawings.

DETAILED DESCRIPTION OF PREFERRED EMBODIMENT

Figure 1:
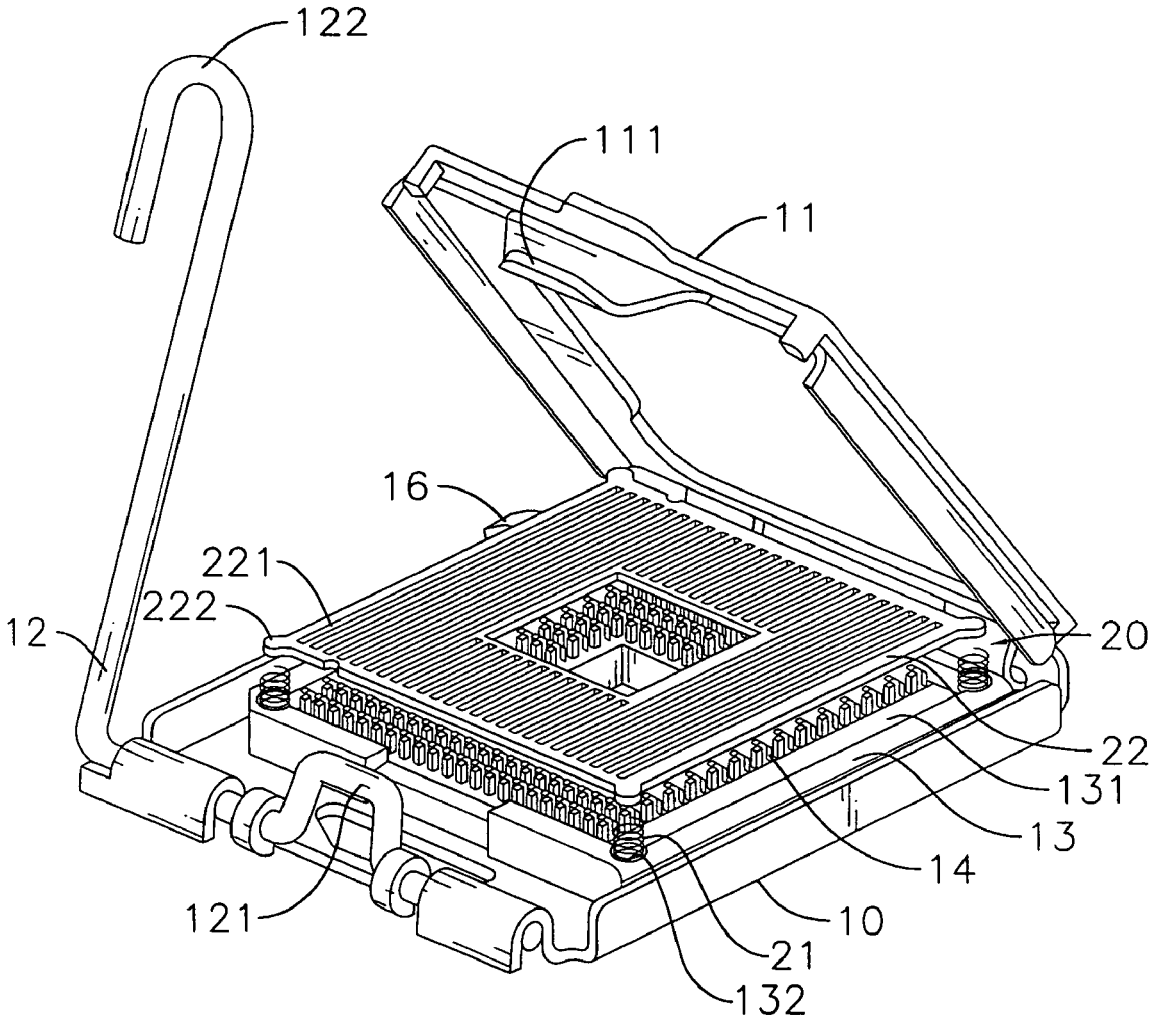
FIG. 1 is an exploded perspective view of a center processing unit (CPU) socket with a cushion in accordance with the present invention.
Figure 5:
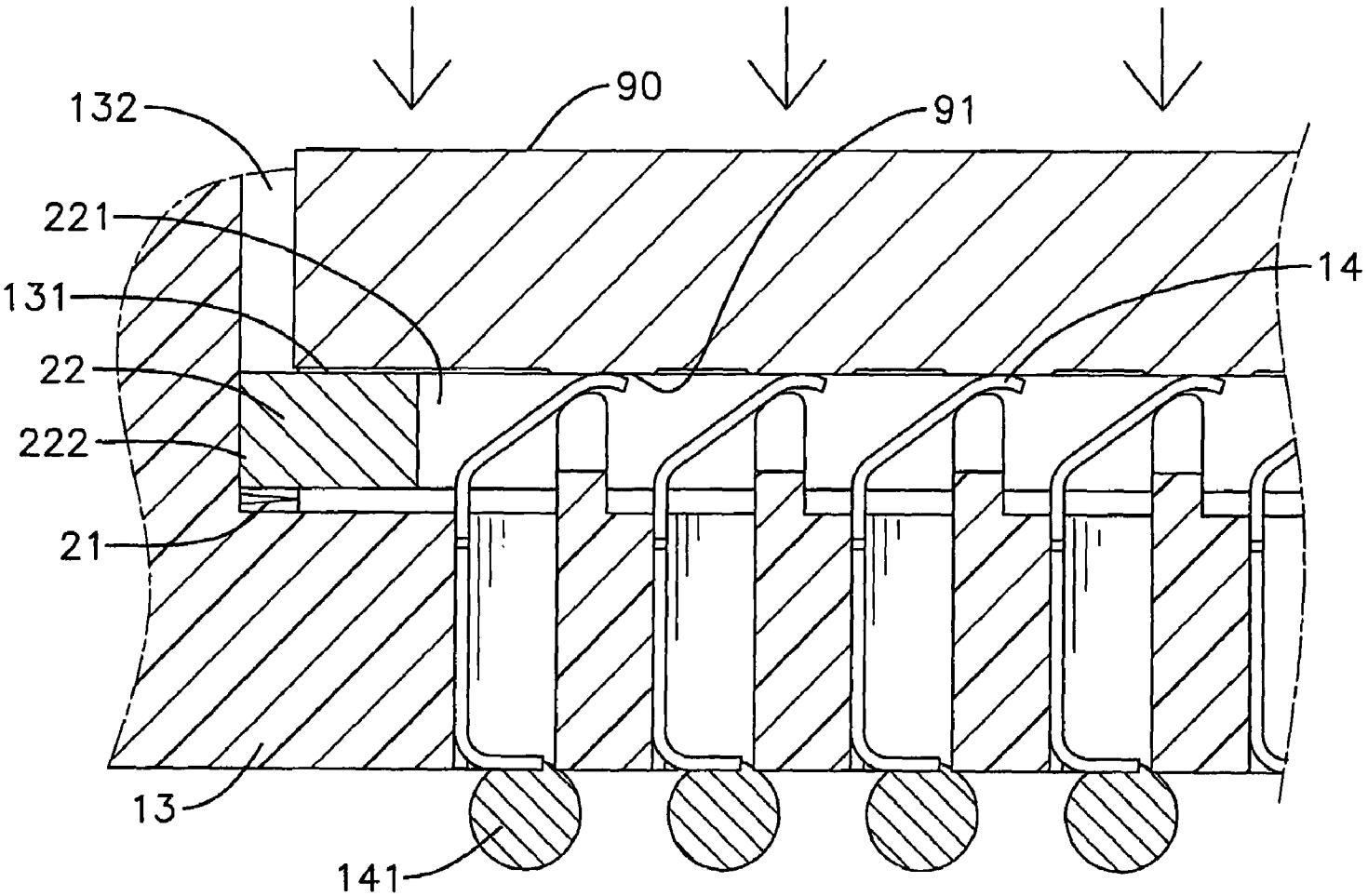
FIG. 5 is an operational side view in partial section of the CPU socket in FIG. 4 with a CPU pressing the CPU backplate down and contacting the contacts.

With reference to FIGS. 1 and 5, a center processing unit (CPU) socket in accordance with the present invention is mounted on a motherboard to hold a CPU (90). The CPU (90) has a bottom and multiple contacts (91) on the bottom.

The CPU socket has a base (10) and a cushion (20).

The base (10) has a top, a bottom, a front, a rear, two opposite sides, an outer edge, a cavity, a catch (16), a contact seat (13), multiple contacts (14), a cover (11) and a latch (12).

The cavity is defined through the top and the bottom of the base (10).

The catch (16) extends from the outer edge of the base (10).

The contact seat (13) is mounted in the cavity in the base (10) and has a top, a bottom, four corners, a recess (131) and multiple mounting holes. The bottom of the contact seat (13) extends out from the bottom of the base (10). The recess (131) is defined in the top of the contact seat (13) and has multiple spring slots (132). The spring slots (132) are defined in the top of the contact seat (13), are located respectively at the corners and, communicate with the recess (131). The mounting holes are defined through the bottom of the contact seat (1) in multiple lines.

The contacts (14) are mounted respectively through the mounting holes in the contact seat (13) and are aligned respectively with the contacts (90) on the bottom of the CPU (91). Each contact (14) has a top contact end, a bottom end and a solder ball (141). The top contact end may be curved and makes contact with a corresponding contact (91) on the CPU (90) mounted in the CPU socket. The solder balls (141) are attached respectively to the bottom ends of the contacts (14) to attach respectively to contacts on the motherboard to mount the CPU socket on the motherboard.

The cover (11) is mounted pivotally on the base (10) and has a front, a rear and a latch tab (111). The rear of the cover (11) is mounted pivotally on a side of the base (10). The latch tab (111) is formed on the front of the cover (11).

The latch (12) is L-shaped, is mounted pivotally on the base (10) and has a locking a and a lever. The locking arm is mounted pivotally on the front of the base (10) and has two ends and a lacking tab (121). The locking tab (121) may be a U-shaped, is formed in the lacking arm and selectively engages the latch tab (111) on the cover (11). The lever perpendicularly extends from one end of the locking arm, selectively engages the catch (16) on the base (10) and has a distal end and a grip (122). The grip (122) is curved and is formed on the distal end of the lever so the latch (12) can be operated easily with the grip (122).

The cushion (20) is mounted in the base (10) and comprises multiple springs (21) and CPU backplate (22).

The springs (21) are mounted in the recess (131) in the contact seat (13) and may be mounted respectively in the spring slots (132) in the recess (131). Each spring (21) has a bottom end and a top end. The bottom ends of the springs (21) are mounted on the bottom of the contact seat (13).

Figure 2:
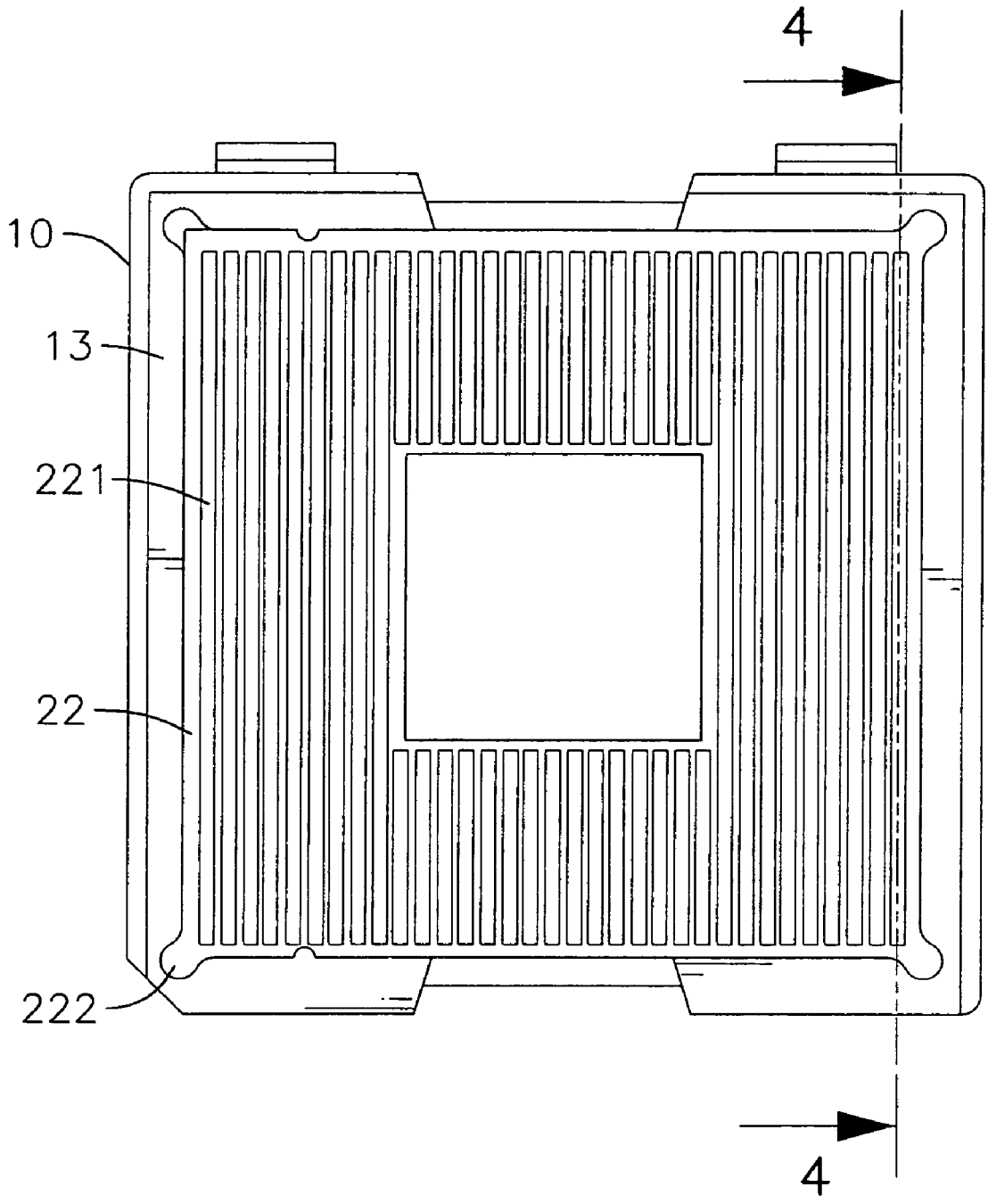
FIG. 2 is a top view of the CPU socket in FIG. 1.
Figure 3:
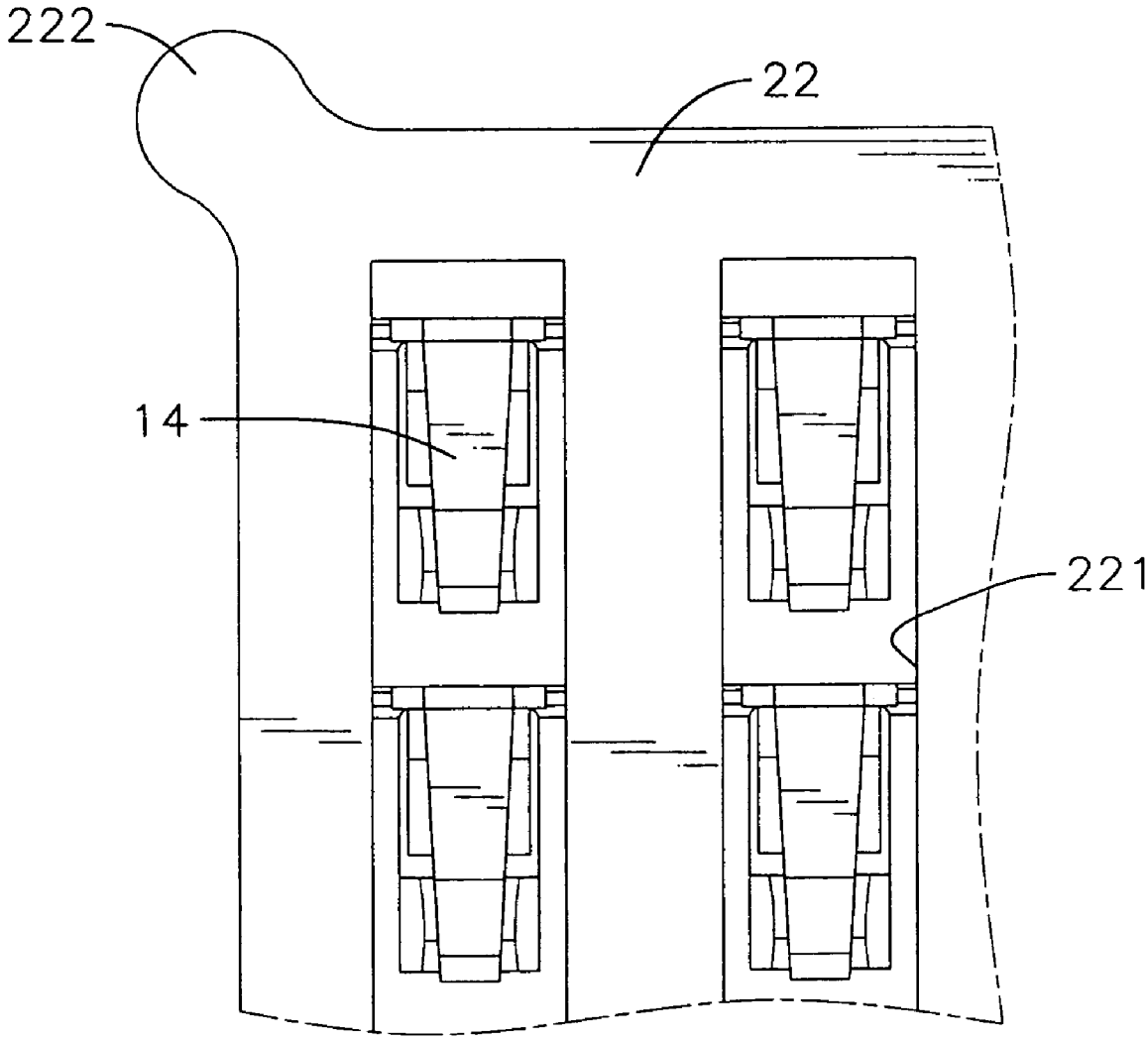
FIG. 3 is an enlarged top view of the CPU socket in FIG. 2.
Figure 4:
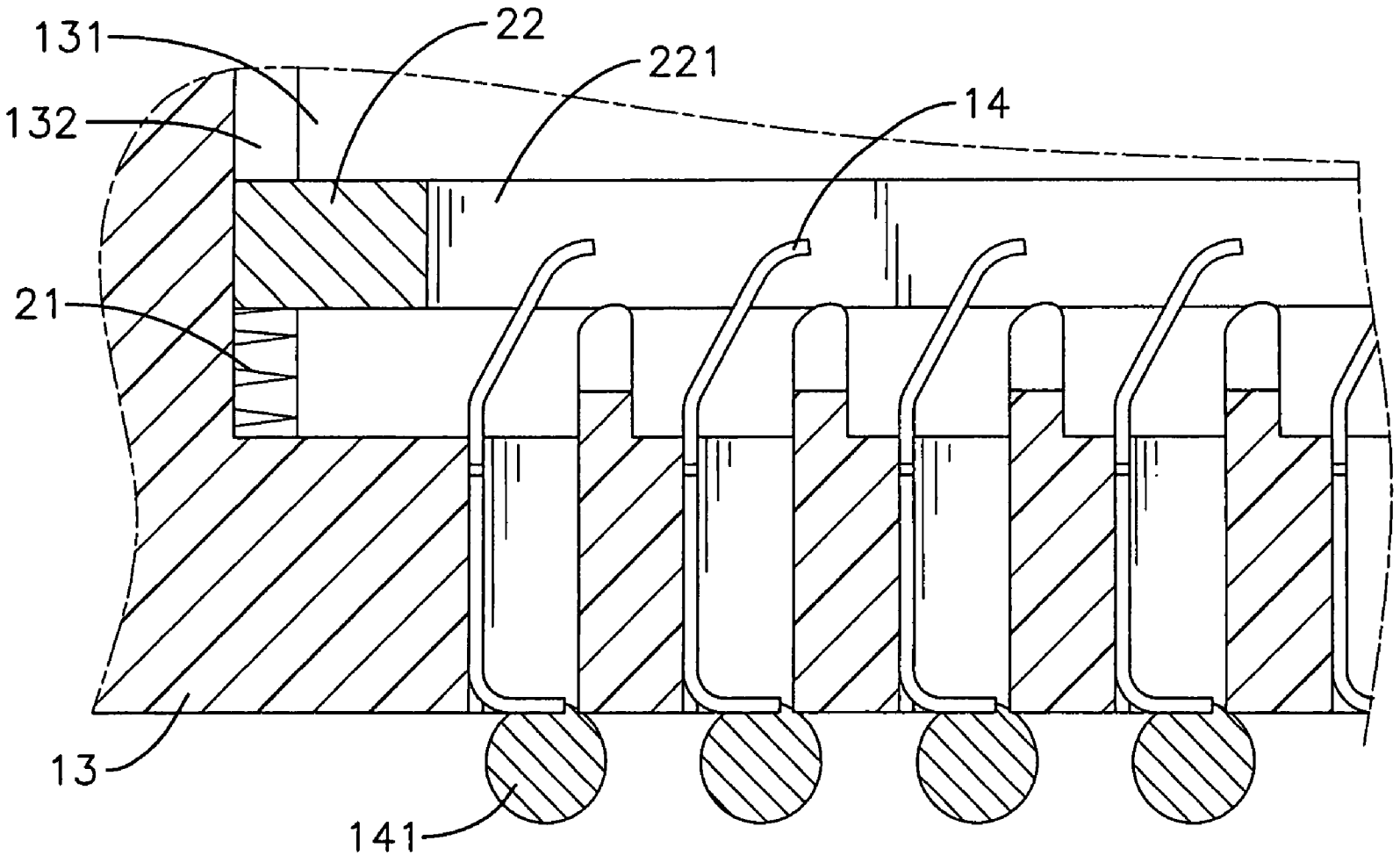
FIG. 4 is a side view in partial section of the CPU socket along line 4—4 in FIG. 2 with the contacts in slots in the cushion.

With reference to FIGS. 2, 3 and 4, the CPU backplate (22) is mounted on the top ends of the springs (21) in the recess (131) in the contact seat (13), cooperates with the springs (21) to cushion the CPU (90) during installation in the CPU socket. The CPU backplate (22) has an outer edge, multiple slots (221) and multiple mounting tabs (222).

The slots (221) are defined through the CPU backplate (22) and are aligned respectively with the contacts (14) in the contact seat (13). When the CPU (90) is installed in the CPU socket, the springs (21) cooperate with the CPU backplate (20) to oppose the force pushing the CPU (90) down and obviate any solid structure contact. Therefore, the contacts (14) make contact respectively with the contacts (91) on the CPU (90) without deforming permanently or being damaged by the force pushing the CUP (90) into the CPU socket.

The mounting tabs (222) extend from the outer edge of the CPU backplate (22) and are mounted respectively on the top ends of the springs (21).

With the CPU backplate (22) cooperating with the springs (21) during installation of the CPU (90) in the CPU socket, the CPU socket becomes more durable.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A central processing unit (CPU) socket comprising:

a base having
- a top;
- a bottom;
- a front;
- a rear;
- two opposite sides;
- an outer edge;
- a cavity defined through the top and the bottom;
- a catch extending from the outer edge of the base;
- a contact seat mounted in the cavity in the base and having a
  - top;
  - four corners:
  - a bottom extending out from the bottom of the base;
  - a recess defined in the top of the contact seat and having multiple slots defined in the top of the contact seat, located respectively at the corners and communicating with the recess; and
  - multiple mounting holes defined through the bottom of the contact seat in multiple lines;
- multiple contacts mounted respectively through the mounting holes in the contact seat, and each contact having a top contact end and a bottom end;
- a cover mounted pivotally on the base and having
  - a front,
  - a rear mounted pivotally on the rear of the base; and a
  - latch tab formed on the front of the cover; and
- a latch being L-shaped, mounted pivotally on the base and having
  - a locking arm mounted pivotally on the front of the base and having
    - two ends; and
    - a locking tab formed in the locking arm and selectively engaging the latch tab on the cover;
  - a lever perpendicularly extending from one end of the locking arm, selectively engaging the catch on the base and having a distal end; and a cushion mounted in the base and comprising
- multiple springs mounted respectively in the spring slots in the recess in the contact seat, each spring having
  - a bottom end mounted on the bottom of the contact seats and
  - a top end; and
- a CPU backplate mounted on the top ends of the springs in the recess in the contact seat and having
  - an outer edge;
  - multiple slats defined through the CPU backplate and aligned respectively with the contacts in the contact seat; and
  - multiple mounting tabs extending from the outer edge and mounted respectively on the top ends of the springs.

2. The CPU socket as claimed in claim 1, wherein the locking tab on the locking arm of the latch is U-shaped.

3. The CPU socket as claimed in claim 2, wherein the latch further has a grip being curved and formed on the distal end of the lever.

4. The CPU socket as claimed in claim 3, wherein each contact in the contact seat further has a solder ball attached to the bottom end of the contact.

* * * * *